US005539365A

United States Patent [19]

Lepretre et al.

[11] Patent Number: 5,539,365

[45] Date of Patent: Jul. 23, 1996

[54] ELECTRICAL PROTECTION APPARATUS WITH CIRCUIT BREAKER AND EFFECTOR

[75] Inventors: Bernard Lepretre, St. Egreve; Francois Reynaud, Reaumont, both of France

[73] Assignee: Schneider Electric SA, France

[21] Appl. No.: 309,891

[22] Filed: Sep. 20, 1994

[30] Foreign Application Priority Data

Oct. 15, 1993 [FR] France ..... 93 12406

[51] Int. Cl.[6] ..... H01H 9/30

[52] U.S. Cl. ..... 335/201; 218/17

[58] Field of Search ..... 335/201, 14, 20; 218/15, 16, 17, 18, 19, 20, 21

[56] References Cited

U.S. PATENT DOCUMENTS 4,616,206 10/1986 Bridges et al. ..... 337/71
4,654,614 3/1987 Chien et al. ..... 335/201

FOREIGN PATENT DOCUMENTS 0104981 4/1984 European Pat. Off. .
0204594 12/1986 European Pat. Off. .
2584529 1/1987 France .

*Primary Examiner*—Lincoln Donovan
*Attorney, Agent, or Firm*—Parkhurst, Wendel & Burr

[57] ABSTRACT

An electrical protection apparatus is disclosed, including a circuit breaker and an effector. The circuit breaker includes a first switch circuit including stationary and movable contacts, provided between input and output terminals. The effector includes a second switch circuit that is provided in series with the first switch circuit. Further, the circuit breaker includes an actuating mechanism for opening the contacts, electromagnetic and thermal trip devices for controlling the actuating mechanism, and first and second guiding horns spaced apart from each other and defining therebetween an arc extinguishing chamber. The first arc guiding horn is electrically connected with the movable contact to the input terminal, while the second arc guiding horn includes a switching electrode extending therefrom, the switching electrode being spaced apart from the stationery contact via an insulating gap. Upon forming an arc between the stationery and movable contacts by tripping of the apparatus, the arc switches to the switching electrode, thereby shunting the effector.

10 Claims, 7 Drawing Sheets

ELECTRICAL PROTECTION APPARATUS WITH CIRCUIT BREAKER AND EFFECTOR

BACKGROUND OF THE INVENTION

The invention relates to an electrical protection apparatus, formed by association of a circuit breaker and an effector, the circuit breaker comprising a first switch circuit with stationary and movable contacts, a mechanism controlled by an electromagnetic trip device with operating coil and by a thermal trip device, a pair of first and second arc guiding horns associated with a switching electrode, arranged near the contacts of the first switch circuit, an arc extinguishing chamber in the trip devices circuit, an input terminal, and an output terminal, the effector having a second switch circuit arranged to be electrically connected in series with said first switch circuit, when the latter is in the closed state, and to be automatically shunted by switching of the arc onto the electrode when the mechanism trips following a fault.

In a known apparatus of the kind mentioned, described in the document EP-A-104,981, the effector is formed by a static switch connected in series with the circuit breaker contacts. In a first embodiment, the switch is connected between the stationary contact and the input terminal, whereas the movable contact is connected to the output terminal by means of the thermal trip device and electromagnetic trip device. The switch remains powered on in the open state of the circuit breaker contacts, and the trip devices, notably the coil of the electromagnetic trip device, are shunted when the arc switches onto the two guiding horns of the arc extinguishing chamber. In the second embodiment, the switch is connected between the trip devices and the output terminal, and the two guiding horns are connected respectively to the input terminal and the output terminal. During tripping of the circuit breaker following a fault, it is necessary to wait until the end of the opening travel of the movable contact for the arc switching to be established enabling shunting of the switch to be achieved. The coil of the electromagnetic trip device is then shunted simultaneously with the switch.

SUMMARY OF THE INVENTION

The object of the invention is to improve the protection and safety of an apparatus combining a circuit breaker a effector.

The apparatus according to the invention is characterized in that:

the effector comprises a first connection strip to the stationary contact and a second connection strip to the second guiding horn and switching electrode, the first guiding horn is connected with the movable contact to the input terminal, and an insulating gap is arranged between the stationary contact and the switching electrode.

In the open state of the first switch circuit of the circuit breaker following manual or automatic action of the mechanism, everything which is load-side of the stationary contact is powered off, notably the entire circuit of the effector. Installation and disassembly operations can then be carried out in complete safety.

According to one feature of the invention, the switching electrode is in electrical connection with one of the ends of the control coil of the electromagnetic trip device, the other end being connected to the output terminal so as to maintain excitation of the coil in the shunting phase of the effector.

In the case of an electromagnetic trip device with striker, the movable contact remains blocked in the open position by the striker throughout the fault clearance phase until the arc has been extinguished.

BRIEF DESCRIPTION OF THE DRAWINGS

Other advantages and features will become more clearly apparent from the following description of an illustrative embodiment of the invention, given as a non-restrictive example only and represented in the accompanying drawings, in which:

In FIGS. 1 and 2, an electrical protection apparatus 10 is formed by association of a circuit breaker 12 with a remote-controlled effector 14. The circuit breaker 12 comprises a first switch circuit 16 electrically connected in series with a second switch circuit 18 of the effector 14.

Figure 1:
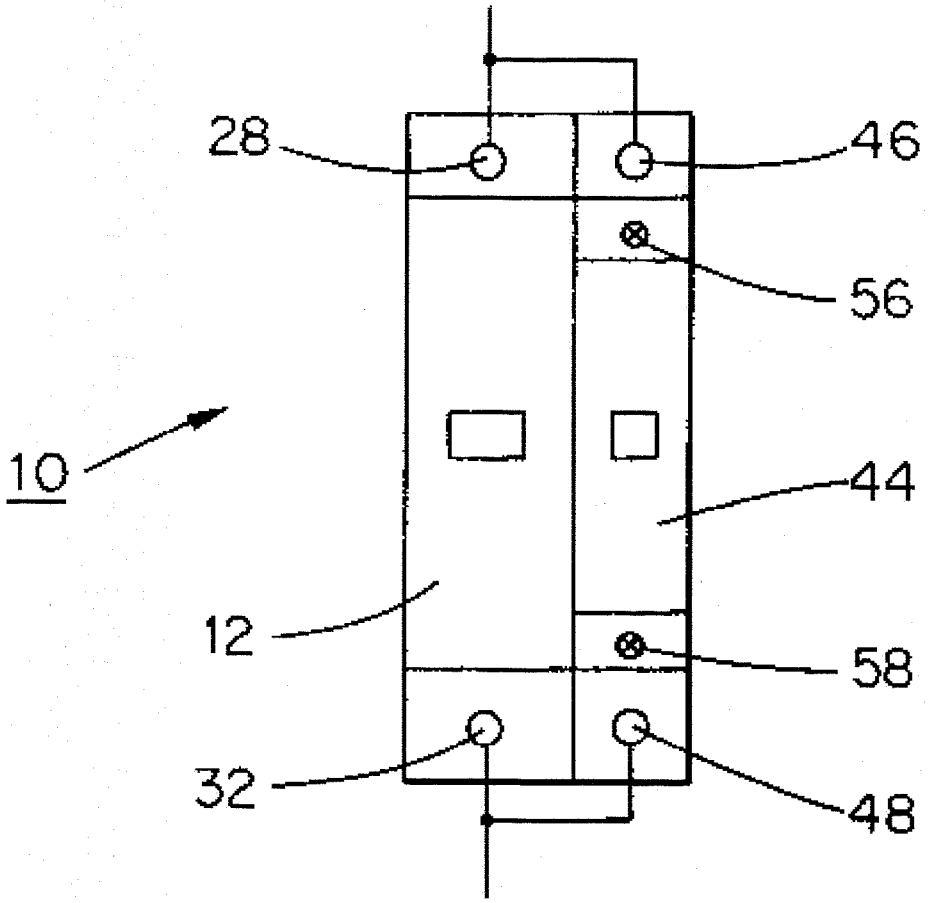
FIG. 1 is a schematic view of a single-pole electrical apparatus according to the invention.

The first switch circuit 16 of the circuit breaker comprises a stationary contact 20 cooperating with a movable contact 22, which is connected by a braid 24 to a bimetal strip of a thermal trip device 26. The foot of the bimetal strip is connected to an input terminal 28 and to a first arc guiding horn 30. The output terminal 32 is connected to one of the ends **34*b* of a coil 34 of an electromagnetic trip device 36, the other end 34*a* being at the potential of a switching electrode 38, and of a second are guiding horn 40. The stationary contact 20 is electrically insulated from the coil 34 and electrode 38 by an insulating gap 42. The electromagnetic trip device 36 is equipped with a tripping part 44 arranged to bring about tripping of the mechanism 43 when a short-circuit current occurs, and to play the role of a striker propelling the movable contact 22 to the open position. The two horns 30, 40 frame an arc extinguishing chamber 45** which is formed by stacking of deionisation plates.

The second switch circuit 18 of the effector 14 is connected to a pair of connection terminals 46, 48 so as to be electrically connected to the stationary contact 20 by a first connecting strip 50, and to the end **34*a* of the coil 34 by a second connecting strip 52. Actuation of the contacts of the second switch circuit 18 is performed by a control device 54 for example of the electromagnet type connected to auxiliary control terminals 56, 58. The two strips 50, 52 are connected respectively to the connection terminals 46, 48 of the effector 14 by a pair of conductors 60, 62**.

The effector 14 can be formed either by a remote-controlled switch, or by an electromagnetic or static contactor, or by any other electrical endurance device, with serial connection of its second switch circuit 18 in the main circuit of the circuit breaker 12.

In the closed state of the circuit breaker 12 and effector 14, the current enters the apparatus 10 via the input terminal 28, flows successively in the bimetal strip of the thermal trip device 26, contacts 22, 20 of the first switch circuit 16, first connecting strip 50, conductor 60, contacts of the second switch circuit 18, conductor 62, second connecting strip 52, and then flows through the coil 34 of the electromagnetic trip device 36 and is output from the apparatus 10 via the output terminal 32.

Operation of a receiver (not represented) connected to the output terminal 32 is achieved normally by actuation of the control device 54 of the effector 14 following sending of a control signal to the auxiliary terminals 56, 58. In the case of a remote-controlled switch, each control impulse applied to the terminals 56, 58 causes a change of state of the second switch circuit 18. If the effector 14 is formed by a contactor, the second switch circuit 18 is continuously in the closed state in the presence of a maintained control signal. Opening of the contactor is automatic as soon as the control signal disappears.

In the open state of the first switch circuit 16 following a manual or automatic action of the mechanism 43 of the circuit breaker 12, everything which is load-side of the stationary contact 20 is powered off, notably the coil 34 of the electromagnetic trip device 36 and the whole circuit of the effector 14. The presence of the insulating gap 42 then enables installation and disassembly operations of the effector 14 to be carried out in complete safety as soon as the circuit breaker 12 is open. The occurrence of a short-circuit or overload current loadside of the output terminal 32 causes automatic tripping of the mechanism 43 by the action of the electromagnetic trip device 36 or of the thermal trip device 26 of the circuit breaker 12. The arc resulting from separation of the contacts 20, 22 develops in the arc formation chamber, and migrates quickly to the switching electrode 38 so as to shunt the effector 14 to protect it from the effects of the fault current. The coil 34 of the electromagnetic trip device 36 continues to be supplied by the arcing current following shunting of the effector 14 throughout the fault clearance phase. Should a short-circuit occur, the striker of the tripping part 44 of the electromagnetic trip device 36 then keeps the movable contact 22 in the open state until the arc is extinguished.

Figure 2:
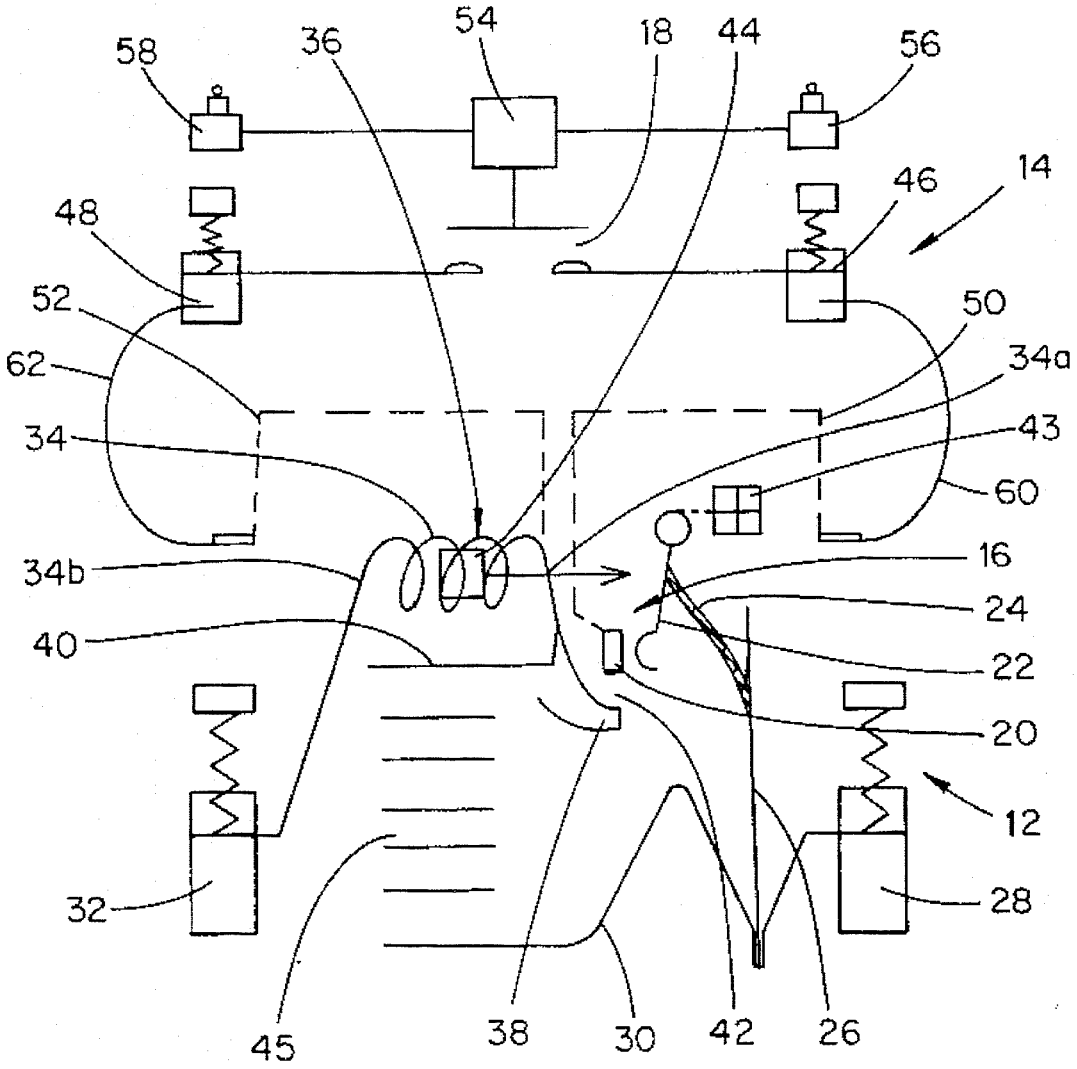
FIG. 2 shows the electrical circuit of the apparatus according to FIG. 1.
Figure 3:
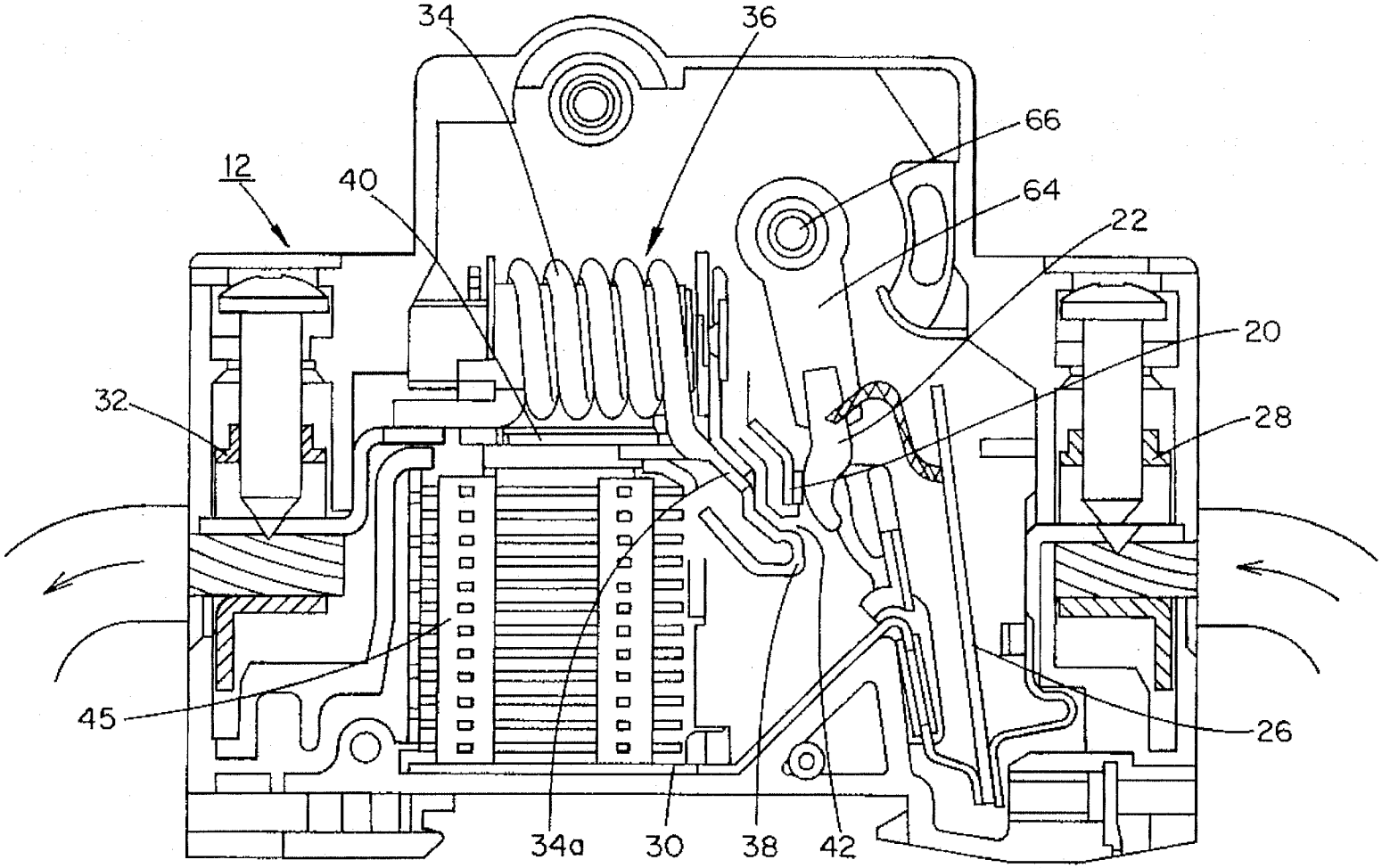
FIG. 3 represents an elevational view of the circuit breaker after the cover has been removed, the circuit breaker being in the closed state.

FIG. 3 shows the circuit breaker 12 in the closed position. The same reference numbers will be used to designate similar parts to those of FIG. 2. The movable contact 22 is supported by a contact arm 64 pivotally mounted on a spindle 66. The strips 50, 52 of the effector 14 are connected respectively to the stationary contact 20 and to the end 34*a* of the coil 34 which is at the potential of the switching electrode 38. The presence of the insulating gap 42 guarantees the insulation withstand between the input and output of the effector 14 when the contacts 20, 22 of the first switch circuit 16 are in the closed position, whereas the second switch circuit 18 is in the open state.

Figure 4:
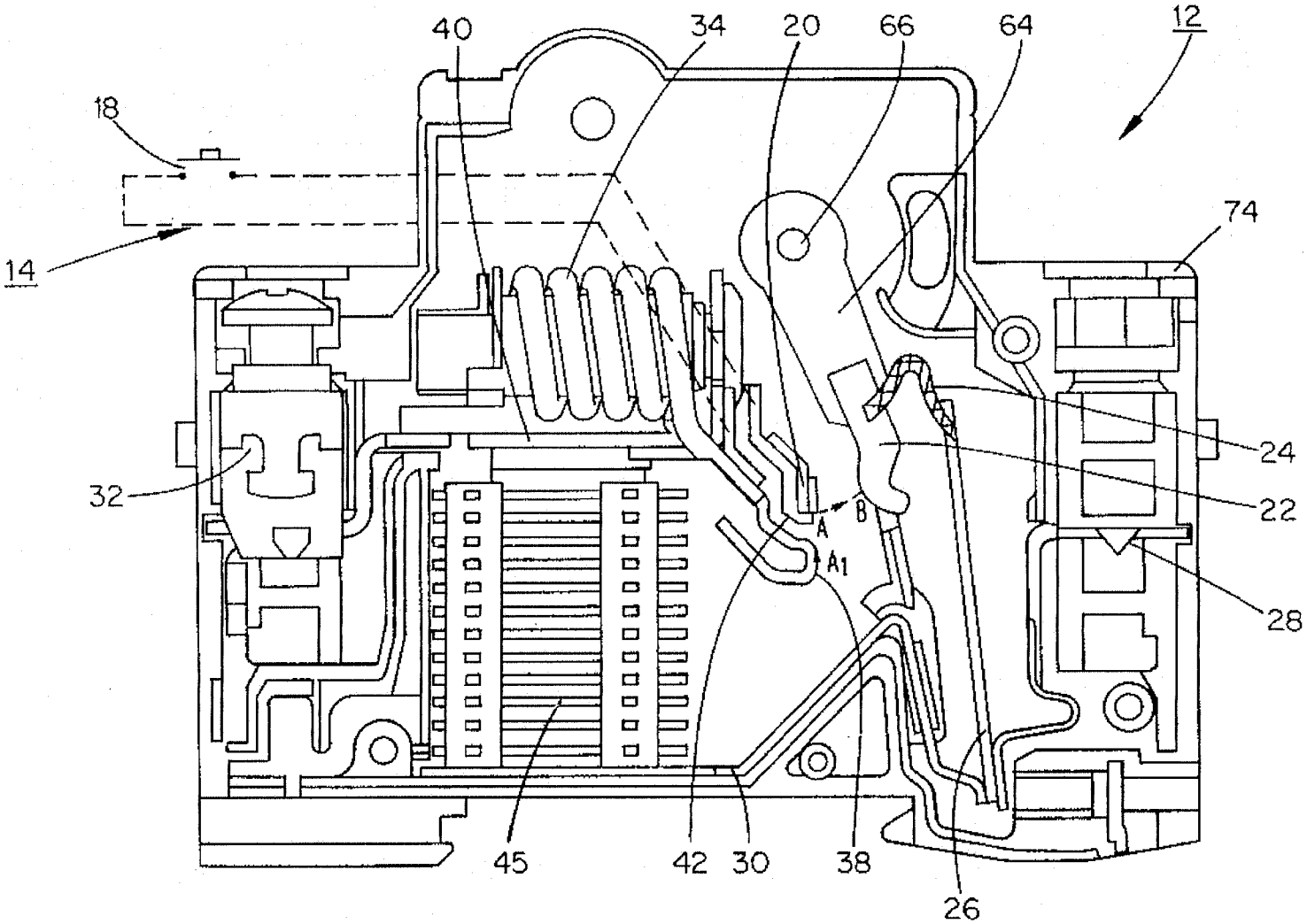
FIGS. 4 and 5 are identical views to FIG. 3, respectively at the beginning and end of the opening travel of the movable contact of the circuit breaker.
Figure 5:
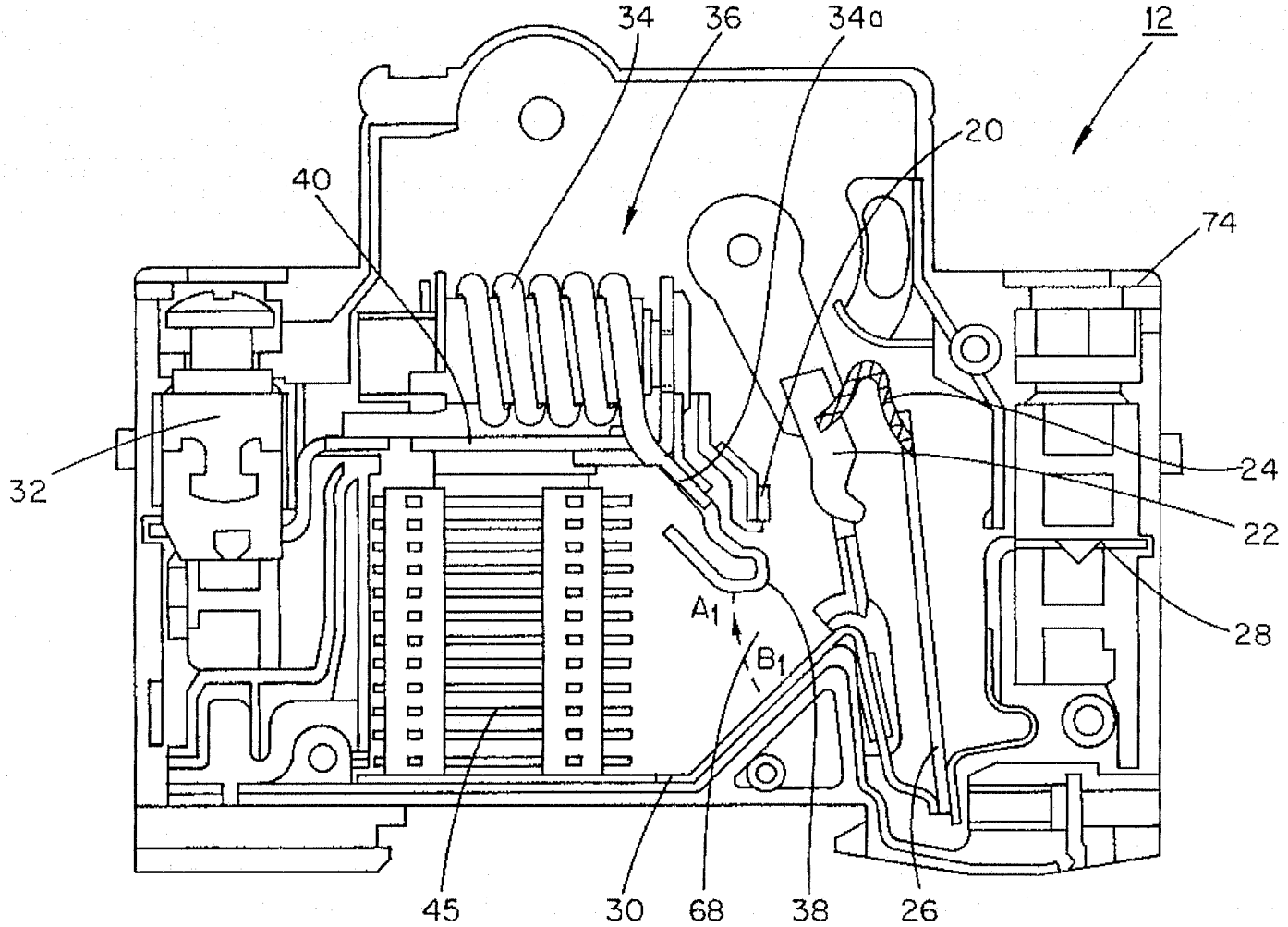

Migration of the arc onto the switching electrode 38 is represented in detail in FIGS. 4 and 5. At the beginning of the opening travel of the movable contact 22 of the circuit breaker 12 (FIG. 4) the arc is established along the path AB between the stationary contact 20 and movable contact 22. The effector 14 still remains electrically connected in series in the main circuit of the circuit breaker 12. Shunting of the effector 14 takes place as soon as the arc root A–B migrates towards the switching electrode 38. The routing A–B of the arc between the movable contact 22 and electrode 38 automatically stops the current flow in the effector 14. FIG. 5 shows the development of the arc $A_1$–$B_1$ in the formation chamber 68 just before it enters the extinguishing chamber 45. It can be noted that the coil 34 of the electromagnetic trip device remains supplied by the fault current so long as the arc moves along the switching electrode 38.

Figure 6:
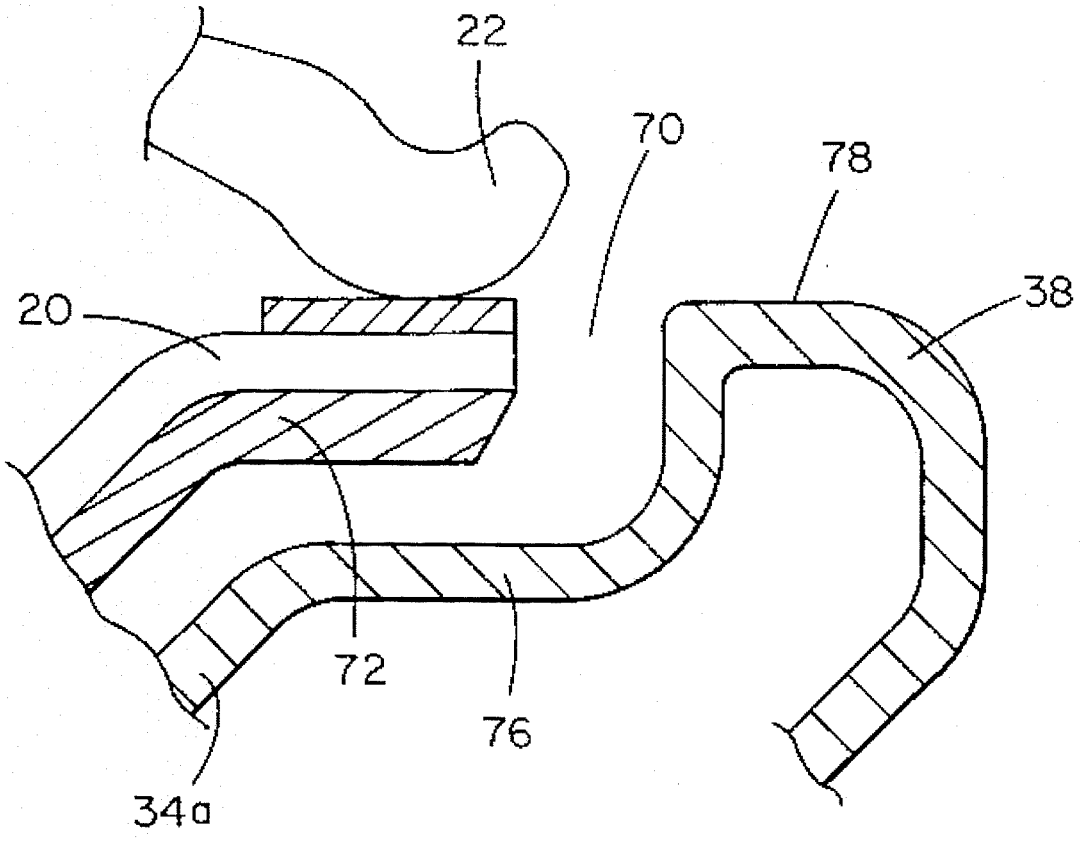
FIG. 6 shows a detailed view of the insulating gap.

In FIG. 6 representing in detail the arc switching zone, the insulating gap 42 is composed of a first air space 70 arranged between the lower part of the stationary contact 20 and the electrode 38 shaped as a half-loop, and of an intermediate wall 72 made of rigid insulating material acting as support for the stationary contact 20. The wall 72 is made by moulding with the plastic case 74 of the circuit breaker 12, and extends opposite the movable contact 22 between the stationary contact 20 and a conducting branch 76 connecting the electrode 38 to the end 34*a* of the coil 34.

The shape of the electrode 38 is adapted to enhance migration of the arc root during the breaking on a fault phase, while guaranteeing the dielectric withstand when the circuit breaker is closed. According to FIG. 6, the electrode 38 is equipped with a straight face 78 disposed in the extension of the plane of the stationary contact pad 20. The face 78 can also be convex to protrude out from the plane of the stationary contact 20.

Figure 7:
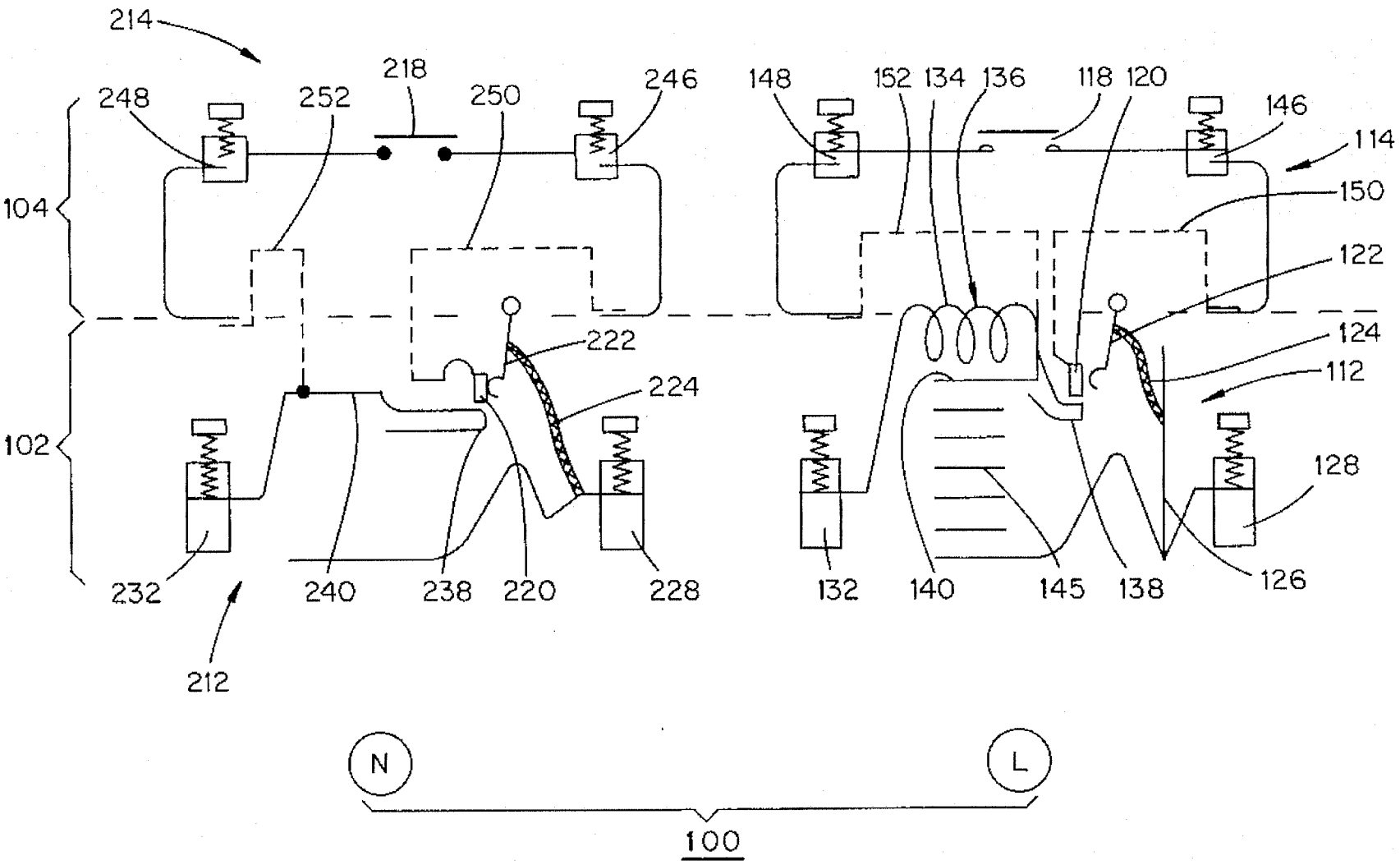
FIG. 7 is an identical view to FIG. 2, representing an alternative embodiment formed by association of a single-pole plus neutral circuit breaker and a two-pole effector.

The alternative embodiment of FIG. 7 relates to a two-pole apparatus 100 formed by association of a single-pole plus neutral circuit breaker 102 and a two-pole effector 104. The phase circuit L with its trip devices 126 and 136 is identical to the diagram of FIG. 2, the reference numbers of the same parts being designated with similar one hundred level numerals. Operation of the phase circuit L of the apparatus 100 presents the same advantages as that described above. In the neutral circuit N, the reference numbers of similar parts are designated with similar two hundred level numerals. The circuit breaker part of the neutral circuit N is not protected and is therefore not equipped with trip devices. The input terminal 228 is connected by the braid 224 to the movable contact 222, and the assembly formed by the guiding horn 240 and electrode 238 is connected directly to the output terminal 232. The connecting strip 250 is connected to the stationary contact 220, whereas the other connecting strip 25f is connected to the guiding horn 240. In the neutral circuit N, series connection of the effector 214 is performed between the stationary contact 220 and the switching electrode 238. The two parts 114, 214 of the two-pole effector 104 are thus powered off when the contacts 120, 220; 122, 222 of the circuit breaker 102 are open.

It is clear that the invention extends to two-pole, three-pole and four-pole circuit breakers, respectively associated with two-pole, three-pole and four-pole effectors.

We claim:

1. An electrical protection apparatus, comprising:

(i) a circuit breaker including a first switch circuit provided between input and output terminals, said first switch circuit including stationary and movable contacts; an actuating mechanism for opening the stationary and movable contacts; electromagnetic and thermal trip devices for controlling the actuating mechanism; a first arc guiding horn electrically connected with the movable contact to the input terminal; a second arc guiding horn spaced apart from the first arc guiding horn; an arc extinguishing chamber provided between the arc guiding horns; a switching electrode extending from the second arc guiding horn and being spaced apart from the stationary contact by an insulating gap; and (ii) an effector including a second switch circuit that is electrically connected in series with the stationary and movable contacts of the first switch circuit, between the stationary contact and the second arc guiding horn, wherein an arc is generated between the stationary and movable contacts upon tripping the apparatus, and said effector is shunted via switching of the arc from the stationary contact to the switching electrode.

2. The apparatus of claim 1, wherein the effector further comprises first and second connection strips respectively interconnecting the effector to the stationary contact and the second arc guiding horn.

3. The apparatus of claim 2, wherein said second switching circuit includes first and second connection terminals respectively connected to the first and second connection strips.

4. The apparatus of claim 1, wherein said electromagnetic trip device includes an operating coil.

5. The apparatus of claim 4, wherein the electromagnetic trip device is connected in series between the switching electrode and the output terminal such that the operating coil is excited during shunting of the effector.

6. The apparatus of claim 1, wherein said effector further comprises an electromagnetic control device for controlling the second switch circuit, said electromagnetic control device receiving a control signal through auxiliary control terminals.

7. The apparatus of claim 1, wherein the thermal trip device includes a bimetal strip connected between the movable contact and the input terminal, said bimetal strip including a foot portion electrically connected to the first arc guiding horn.

8. The apparatus of claim 1, wherein the effector provides two poles, and the circuit breaker provides a single pole and a neutral circuit.

9. The apparatus of claim 1, wherein said effector provides a remote-control switch.

10. The apparatus of claim 1, wherein said effector provides an electromagnetic or static contactor.

* * * * *